US005605766A

United States Patent [19]

Arimura et al.

[11] Patent Number: 5,605,766

[45] Date of Patent: Feb. 25, 1997

[54] THERMAL TRANSFER RECORDING MEDIUM

[75] Inventors: Takao Arimura; Motoshi Morimoto, both of Osaka, Japan

[73] Assignee: Fujicopian Co., Ltd., Osaka, Japan

[21] Appl. No.: 356,652

[22] Filed: Dec. 15, 1994

[30] Foreign Application Priority Data

Dec. 16, 1993 [JP] Japan ..... 5-316632

[51] Int. Cl.[6] ..... B41M 5/26

[52] U.S. Cl. ..... 428/488.4; 428/195; 428/484; 428/488.1; 428/913

[58] Field of Search ..... 428/195, 484, 428/488.1, 488.4, 913

[56] References Cited

U.S. PATENT DOCUMENTS 5,362,548 11/1994 Hiyoshi et al. ..... 428/195

5,362,549 11/1994 Imamura et al. ..... 428/195

*Primary Examiner*—Pamela R. Schwartz

*Attorney, Agent, or Firm*—Fish & Neave

[57] ABSTRACT

A thermal transfer recording medium comprising a foundation, and a release layer and a heat-meltable colored ink layer provided on the foundation in that order, the release layer containing 50 to 100% by weight of a polyethylene wax having a melting or softening point of not lower than 100° C., the heat-meltable colored ink layer comprising a coloring agent and a vehicle, the vehicle containing 50 to 100% by weight of carnauba wax. The recording medium gives clear print images having excellent fastness without causing falling of ink and is useful for bar code printing.

5 Claims, 1 Drawing Sheet

THERMAL TRANSFER RECORDING MEDIUM

BACKGROUND OF THE INVENTION

The present invention relates to a thermal transfer recording medium. More particularly, it relates to a thermal transfer recording medium favorably used for forming print images such as bar codes for which fastness such as abrasion resistance or scratch resistance is required.

Heretofore there was known a thermal transfer recording medium comprising a foundation having thereon a heat-meltable colored ink layer wherein an undercoating layer (release layer) composed predominantly of a resin and/or a wax is interposed between the foundation and the heat-meltable colored ink layer, thereby improving the transferability and preventing the obtained print images from smearing due to protection of them with the release layer (Japanese Unexamined Patent Publication No. 147292/1990).

However, the present inventor's research revealed that it was difficult to meet both clearness and fastness required for bar codes by simply providing the release layer between the foundation and the heat-meltable colored ink layer.

An object of the present invention is to provide a thermal transfer recording medium capable of forming print images which particularly meet both dearness and fastness required for bar codes.

This and other objects of the present invention will become apparent from the description hereinafter.

SUMMARY OF THE INVENTION

The present invention provides a thermal transfer recording medium comprising a foundation, and a release layer and a heat-meltable colored ink layer provided on the foundation in that order, the release layer containing 50 to 100% by weight of a polyethylene wax having a melting or softening point of not lower than 100° C., the heat-meltable colored ink layer comprising a coloring agent and a vehicle, the vehicle containing 50 to 100% by weight of carnauba wax.

DETAILED DESCRIPTION

Figure 1:
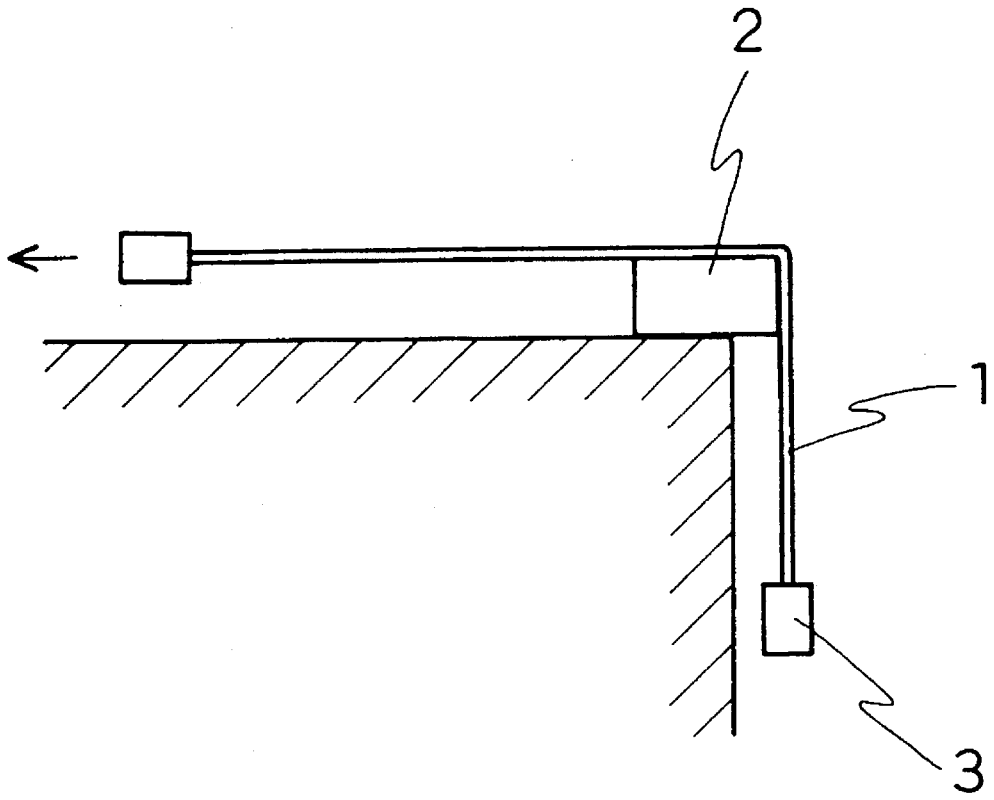
FIG. 1 is a schematic view illustrating a test method for evaluating "falling of ink" of a thermal transfer recording medium.

From the viewpoint of the fastness of print image, carnauba wax is most suitable as the vehicle of the heat-meltable colored ink layer for a thermal transfer recording medium for use in bar code printing.

However, a heat-meltable colored ink layer containing carnauba wax as the main component of the vehicle thereof has the drawback of causing the so-called "falling of ink". The term "falling of ink" referes to a phenomenon in which portions of the ink layer are peeled off in the form of powder, flakes or the like from the foundation when the ink layer comes into contact with members provided in a running path or the like during traveling of the ink ribbon or the like.

It may be considered to enhance an adhesion between the foundation and the release layer for preventing the falling of ink. However, when the adhesion is simply enhanced, the transfer of the ink layer is hindered.

In the present invention, it has been discovered that by using a release layer composed predominantly of a polyethylene wax, falling of ink is prevented even in the case of a heat-meltable colored ink layer wherein the vehicle thereof is composed predominantly of carnauba wax, thereby realizing clear print images with excellent fastness without falling of ink.

The release layer in accordance with the present invention contains 50 to 100% (% by weight, hereinafer the same), preferably 60 to 95% of a polyethylene wax having a melting or softening point of not lower than 100° C.

In the present invention, the falling of ink can be prevented without hindering the transferability by composing the release layer of a polyethylene wax. When another wax, for instance, carnauba wax is used instead of the polyethylene wax, the falling of ink cannot be prevented. When the content of the polyethylene wax in the release layer is less than the above range, the adhesion of the release layer to the foundation is reduced, so that the falling of ink occurs and further the selective transferability of the release layer degrades. Selective transferability, as used herein, referes to the property that only a heated portion of a layer is transferred but an unheated portion in the periphery of the heated protion is not transferred. The degraded selective transferability of the release layer causes undesirable phenomena such as smudged image and tailing phenomenon. Herein, the tailing phenomeneon referes to the smearing of a receptor with the ink like a tail on the opposite side of the print image relative to the traveling direction of a thermal head.

The polyethylene wax used in the present invention has a melting or softening point of not lower than 100° C. When a polyethylene wax having a melting or softening point lower than 100° C. is used, the adhesion of the release layer to the foundation is reduced, so that the falling of ink occurs and the selective transferability of the release layer degrades further. The degraded selective transferability causes smudged print images and tailing phenomenon. The upper limit of the melting or softening point of the polyethylene wax is not particularly limited. However, from the viewpoint of transfer sensitivity, the polyethylene wax preferably has a melting or softening point of not higher than 140° C.

Any polyethylene wax can be used regardless of the type thereof as far as it has a melting or softening point within the aforesaid range, including usual non-modified type(non-oxidized type) of polyethylene wax and modified type (oxidized type) of polyehtylene wax. These polyethylene waxes can be used either singly or in admixture.

Examples of the non-modified type polyethylene wax include Hiwax 100P, 200P, 110P, 210P and 220P (all made by Mitsui Petrochemical Industries, Ltd. ), A-C polyethylene A-C6, A-C7, A-C8, A-C9, A-C617, A-C712, A-C715, A-C725, A-C735, A-C6A, A-C7A, A-C8A, A-C9A and A-C617A (all made by Allied Signal Inc.), Sanwax 151-P and 171-P (all made by Sanyo Chemical Industries, Ltd), and Bareco Polywax 655, 1000 and 2000 (all made by Petrolite Corporation). Examples of the modified polyethylene wax include Hiwax 210MP, 220MP, 1105A, 1120H and 1160H (all made by Mitsui Petrochemical Industries, Ltd. ), A-C polyethylene A-C629, A-C655, A-C656, A-C680 and A-C629A (all made by Allied Signal Inc.), Sanwax E-300 and E-250-P (all made by Sanyo Chemical Industries, Ltd.), and Bareco E-2018 and E-2020 (all made by Petrolite Corporation).

The release layer in the present invention can be incorporated with other waxes for adjusting the melt viscosity thereof and/or a heat-meltable resin for adjusting adhesion of the release layer to the foundation, in addition to the polyethylene wax.

Examples of the aforesaid other waxes include carnauba wax, candelilla wax, paraffin wax, microcrystalline wax, α-olefin-maleic anhydride copolymer wax, Fischer-Tropsch wax, montan wax and petrolatum. These waxes can be used either alone or in combination.

Examples of the aforesaid heat-meltable resin include ethylene-vinyl acetate copolymer, ethylene-ethyl acrylate copolymer, acrylic resins, polyvinyl acetate, petroleum resins, hydrocarbon resins, polybutadiene, polystyrene, rosin resins and terpene resins. These resins can be used either alone or in combination.

The preferred release layer comprises 50 to 95% (more preferably 60 to 90%) of the polyethylene wax, 2.5 to 30% (more prefearbly 5 to 25%) of the other wax, and 2.5 to 20% (more preferably 5 to 15%) of the heat-meltable resin.

The thickness of the release layer is preferably from about 0.2 to about 1.5 g/m$^2$ in terms of coating amount (on dry weight basis, hereinafter the same). When the coating amount is less than the above range, the release effect is prone to be insufficiently exhibited. When the coating amount is more than the above range, the transfer sensitivity is prone to decrease.

The heat-meltable colored ink layer in the present invention comprises a coloring agent and a heat-meltable vehicle, the vehicle containing 50 to 100%, preferably 80 to 100% of carnauba wax.

In the present invention, such a heat-meltable vehicle composed predominantly of carnauba wax is used as the vehicle for the heat-meltable colored ink layer, thereby obtaining print images having excellent fastness. When the content of carnauba wax in the vehicle is lower than the above range, print images having excellent fastness cannot be obtained and the selective transferability of the ink layer degrades.

The vehicle can be incorporated with other wax and/or a heat-meltable resin, in addition to carnauba wax.

Examples of the aforesaid other waxes include candelilla wax, paraffin wax, microcrystalline wax, α-olefin-maleic anhydride copolymer wax, Fischer-Tropsch waxes, montan wax and petrolatum. These waxes can be used either alone or in combination.

Examples of the aforesaid heat-meltable resin include ethylene-vinyl acetate copolymer, ethylene-ethyl acrylate copolymer, acrylic resins, polyvinyl acetate, petroleum resins, hydrocarbon resins, polybutadiene, polystyrene, rosin resins and terpene resins. These resins can be used either alone or in combination.

Usable as the coloring agent for the ink layer in the present invention are carbon black as well as various organic and inorganic coloring agents, magnetic powders, and the like. The content of the coloring agent in the ink layer is usually about 5 to about 30%.

If necessary, the ink layer may be incorporated with additives such as dispersing agent in addition to the vehicle and the coloring agent within the range of not injuring the object of the present invention.

The coating amount of the ink layer is preferably from about 0.5 to about 2 g/m$^2$ from the viewpoint of the print image density and transfer sensitivity.

In the present invention, an adhesive layer may be provided on the ink layer to improve adhesion to a receptor, thereby further improving the transferability of the ink layer or preventing the smearing of the receptor.

The preferred adhesive layer is composed predominantly of a wax and contains substantially no coloring agent. Examples of the wax include carnauba wax, candelilla wax, paraffin wax, microcrystalline wax and montan wax. These waxes can be used either alone or in combination.

The coating amount of the adhesive layer is preferably from about 0.2 to about 1 g/m$^2$ from the viewpoint of the adhesion and transfer sensitivity.

In the present invention, from the viewpoint of improving transfer sensitivity, the total coating amount of the release layer and the ink layer (and further the adhesive layer when provided) is preferably not more than 3.5 g/m$^2$.

As the foundation in the present invention, usable are polyester films such as polyethylene terephthalate film, polyethylene naphthalate film and polyarylate film, polycarbonate films, polyamide films, aramid films and other various plastic films commonly used for the foundation. of ink ribbons of this type. Thin paper sheets of high density such as condenser paper can also be used. The thickness of the foundation is preferably within the range of about 1 to about 10 μm, more preferably about 2 to about 7 μm, for improving heat conduction.

On the back side (the side adapted to come into slide contact with a thermal head) of the foundation may be formed a conventionally known stick-preventive layer. Examples of the materials for the stick-preventive layer include various heat-resistant resins such as silicone resin, fluorine-containing resin and nitrocellulose resin, and other resins modified with these heat-resistant resins such as silicone-modified urethane resins and siliconemodified acrylic resins, and mixtures of the foregoing heat-resistant resins and lubricating agents.

The present invention will be more fully described by way of Examples. It is to be understood that the present invention is not limited to the Examples, and various changes and modifications may be made in the invention without departing from the spirit and scope thereof.

EXAMPLES 1 TO 4 AND COMPARATIVE EXAMPLES 1 TO 8

Onto one side of a 3.5 μm-thick polyethylene terephthalate film which was provided on the other side thereof with a 0.1 μm-thick stick-preventing layer composed of a silicone-modified urethane resin were successively formed a release layer having the formula shown in Table 1 and a coating amount of 1.0 g/m$^2$ and a heat-meltable colored ink layer having the formula shown in Table 1 and a coating amount of 1.0 g/m$^2$. In Examples 3 to 4 and Comparative Examples 5 to 8, on the thus obtained ink layer was further formed an adhesive layer having the formula shown in Table 1 and a coating amount of 0.5 g/m$^2$.

In that case, each release layer was formed by applying a coating liquid composed of 100 parts (parts by weight, hereinafter the same) of all materials for each release layer shown in Table 1 and 900 parts of toluene by means of a bar coater, followed by drying. Each ink layer was formed by applying a coating liquid composed of 100 parts of all materials for each ink layer shown in Table 1 and 800 parts of isopropyl alcohol by means of a bar coater, followed by drying. Each adhesive layer was formed by applying a coating liquid composed of 100 parts of the material for each adhesive layer shown in Table 1, 500 parts of methanol and 500 parts of toluene by means of a bar coater, followed by drying.

TABLE 1

| | Ex. 1 | Ex. 2 | Ex. 3 | Ex. 4 | Com. Ex. 1 | Com. Ex. 2 | Com. Ex. 3 | Com. Ex. 4 | Com. Ex. 5 | Com. Ex. 6 | Com. Ex. 7 | Com. Ex. 8 |
|---|---|---|---|---|---|---|---|---|---|---|---|---|
| Release layer (%) | | | | | | | | | | | | |
| Polyethylene wax* (m.p. 116° C.) | 70 | 80 | 70 | 80 | 40 | | 10 | 70 | 40 | | 10 | 70 |
| Polyethylene wax (m.p. 80° C.) | | | | | | 70 | | | | 70 | | |
| Carnauba wax (m.p. 85° C.) | 10 | 5 | 10 | 5 | 30 | 10 | 70 | 10 | 30 | 10 | 70 | 10 |
| α-Olefin-maleic anhydride copolymer wax (m.p. 75° C.) | 10 | 5 | 10 | 5 | 20 | 10 | 10 | 10 | 20 | 10 | 10 | 10 |
| Ethylene-vinyl acetate copolymer (m.p. 60° C.) | 10 | 10 | 10 | 10 | 10 | 10 | 10 | 10 | 10 | 10 | 10 | 10 |
| Ink layer (%) | | | | | | | | | | | | |
| Carnauba wax (m.p. 85° C.) | 70 | 70 | 70 | 70 | 70 | 70 | 70 | 30 | 70 | 70 | 70 | 30 |
| α-Olefin-maleic anhydride copolymer wax (m.p. 75° C.) | | | | | | | | 40 | | | | 40 |
| Carbon black | 20 | 20 | 20 | 20 | 20 | 20 | 20 | 20 | 20 | 20 | 20 | 20 |
| Homogenol (dispersing agent made by Kao Corp.) | 10 | 10 | 10 | 10 | 10 | 10 | 10 | 10 | 10 | 10 | 10 | 10 |
| Adhesive layer (%) | | | | | | | | | | | | |
| Carnauba wax (m.p. 85° C.) | | | 100 | 100 | | | | | 100 | 100 | 100 | 100 |

*: Bareco Polywax 1000

Each of the thus obtained thermal transfer recording media was evaluated for transfer sensitivity, selective transferability, falling of ink and fastness of print image by the following test methods. The results are shown in Table 2.

(1) Transfer sensitivity

Each of the thermal transfer recording media was used in a bar code printer (B-30 made by Tokyo Electric Co., Ltd.) to print bar codes on a high-quality paper sheet. An optimum printing energy E (volt) required for transferring a clear thin line having a line width of 1 mm was determined and compared with the standard energy Es (volt) stipulated for the printer. The results were rated as follows.

3 $E<Es$

2 $Es \leqq E<Es+1$

1 $Es+1 \leqq E$ (2) Selective transferability

Bar codes were printed in the same manner as in the above (1) except that printing was performed at the optimum energy E determined in the above (1). The bar codes thus obtained on the high-quality paper sheet were read with a bar code scanner. The results were rated as follows:

3 Readable under the requirements in a standard (Code 39)

2 Readable but fail to meet the requirements

1 Unreadable (3) Falling of ink

There was used a test device shown in FIG. 1 wherein a member 2 having a right-angled corner was fixed on an edge of a table. A thermal transfer recording medium 1 (width: 10 mm) was arranged so that the ink layer of the recording medium 1 was brought into contact with the corner. A weight 3 was attached to the end of the recording medium 1 that hung down from the table. In such a state, the other end of the recording medium 1 was pulled horizontally at a speed of 140 cm/min. This operation was repeated while successively replacing the weight 3 with a heavier one. It was determined what the gram number of the weight 3 was when the ink layer was peeled off. The results were rated as follows: A larger gram number of the weight 3 indicates that the falling of ink is difficult to occur.

3 Falling of ink did not occur even when a 100-gram weight was used.

2 Falling of ink occurred when a 100-gram weight was used but did not occur when a 50-gram weight was used.

1 Falling of ink occurred even when a weight of lighter than 50 grams was used.

(4) Fastness of print image

Bar codes were printed in the same manner as in the above (1) except that printing was performed at the optimum energy E determined in the above (1). With use of a crock meter made by ATLAS ELECTRIC DEVICE COMPANY, the bar codes obtained on the high-quality paper sheet were rubbed by moving a cotton cloth to and fro 30 times under a load of 500 g/cm$^2$. The results were rated as follows:

3 No broken portion occurred in the bar code and the cotton cloth was not stained.

2 No broken portion occurred in the bar code but the cotton cloth was stained.

1 Broken portions occurred in the bar code.

TABLE 2

| | Ex. 1 | Ex. 2 | Ex. 3 | Ex. 4 | Com. Ex. 1 | Com. Ex. 2 | Com. Ex. 3 | Com. Ex. 4 | Com. Ex. 5 | Com. Ex. 6 | Com. Ex. 7 | Com. Ex. 8 |
|---|---|---|---|---|---|---|---|---|---|---|---|---|
| Transfer sensitivity | 3 | 3 | 3 | 3 | 2 | 3 | 2 | 3 | 2 | 3 | 2 | 3 |
| Selective transferability | 3 | 3 | 3 | 3 | 2 | 1 | 3 | 1 | 2 | 1 | 3 | 1 |
| Falling of ink | 3 | 3 | 3 | 3 | 3 | 3 | 1 | 3 | 3 | 3 | 1 | 3 |
| Fastness of print image | 3 | 3 | 3 | 3 | 3 | 2 | 3 | 2 | 3 | 2 | 3 | 3 |

In addition to the materials and ingredients used in the Examples, other materials and ingredients can be used in the Examples as set forth in the specification to obtain substantially the same results.

As has been described, the thermal transfer recording medium of the present invention gives clear print images having excellent fastness. Accordingly it is useful for forming bar codes.

What is claimed is:

1. A thermal transfer recording medium comprising a foundation, and a release layer and a heat-meltable colored ink layer provided on the foundation in that order, the release layer containing 50 to 100% by weight of a polyethylene wax having a melting or softening point of not lower than 100° C., the heat-meltable colored ink layer comprising a coloring agent and a vehicle, the vehicle containing 50 to 100% by weight of carnauba wax.

2. The thermal transfer recording medium of claim 1, which further comprises an adhesive layer provided on the heat-meltable colored ink layer.

3. The thermal transfer recording medium of claim 2, wherein the total coating amount of the release layer, the heat-meltable colored layer and the adhesive layer is not more than 3.5 g/m$^2$ on a dry weight basis.

4. The thermal transfer recording medium of claim 1, wherein the total coating amount of the release layer and the heat-meltable colored ink layer is not more than 3.5 g/m$^2$ on a dry weight basis.

5. The thermal transfer recording medium of claim 1, wherein the release layer contains 50 to 95% by weigh of the polyethylene wax, 2.5 to 30% by weight of a wax other than the polyethylene wax and 2.5 to 20% by weight of a heat-meltable resin.

* * * * *

UNITED STATES PATENT AND TRADEMARK OFFICE

CERTIFICATE OF CORRECTION

PATENT NO. : 5,605,766

DATED : February 25, 1997

INVENTOR(S) : Takao Arimura, et al

It is certified that error appears in the above-identified patent and that said Letters Patent is hereby corrected as shown below:

Column 1, line 28 delete "dearness" and substitute therefor -- clearness --.

Column 1, line 58 delete "referes" and substitute therefor -- refers --.

Column 2, line 9 delete "hereinafer" and substitute therefor -- hereinafter --.

Column 2, line 21 delete "referes" and substitute therefor -- refers --.

Column 2, line 24 delete "protion" and substitute therefor -- portion --.

UNITED STATES PATENT AND TRADEMARK OFFICE

CERTIFICATE OF CORRECTION

PATENT NO. : 5,605,766

DATED : February 25, 1997

INVENTOR(S) : Takao Arimura, et al

It is certified that error appears in the above-identified patent and that said Letters Patent is hereby corrected as shown below:

Column 2, line 27 delete "phenomeneon referes" and substitute therefor -- phenomenon refers --.

Column 2, line 46 delete "polyehtylene" and substitute therefor -- polyethylene --.

Column 3, line 38 delete "wax" and substitute therefor -- waxes --.

Column 4, line 31 delete "siliconemodified" and substitute therefor -- silicone-modified --.

Column 8, line 13 delete "weigh" and substitute therefor -- weight --.

Signed and Sealed this

Twenty-sixth Day of September, 2000

*Attest:*

*Attesting Officer*

Q. TODD DICKINSON

*Director of Patents and Trademarks*